United States Patent [19]

Horsch et al.

[11] Patent Number: 4,828,045

[45] Date of Patent: May 9, 1989

[54] DOZER BLADE VISUAL TILT INDICATOR

[75] Inventors: Rudolf Horsch, Wausau; Claude M. Frisbee, Schofield; Ronald H. Werner, Edgar, all of Wis.

[73] Assignee: J. I. Case Company, Racine, Wis.

[21] Appl. No.: 118,682

[22] Filed: Nov. 9, 1987

[51] Int. Cl.[4] ..... E02F 3/815

[52] U.S. Cl. ..... 172/821; 172/430; 37/DIG. 19

[58] Field of Search ..... 172/430, 821, 4.5, 810, 172/817, 818, 819, 820, 822, 823, 824, 827; 37/DIG. 19

[56] References Cited

U.S. PATENT DOCUMENTS

| | | | |
|---|---|---|---|
| 2,775,831 | 1/1957 | Rockwell | 172/430 X |
| 3,017,046 | 1/1962 | Runci | 37/DIG. 19 |
| 3,900,073 | 8/1975 | Crum | 172/430 |
| 4,053,017 | 10/1977 | Gill | 172/4.5 |
| 4,201,268 | 5/1980 | Frisbee | 172/821 X |
| 4,286,386 | 9/1981 | Long | 172/430 |
| 4,364,439 | 12/1982 | Asal | 172/821 |

*Primary Examiner*—Richard J. Johnson

[57] ABSTRACT

A visual tilt indicator for an implement, particularly but not exclusively for indicating the tilt angle of a dozer blade on a tractive vehicle, wherein the implement is pivotally supported on the vehicle by an implement universal joint and the support includes hydraulic cylinders operably interconnected between the vehicle and the implement to angle and tilt the implement. The visual tilt indicator of this invention includes an indicator shaft which is operably connected to the vehicle by a universal joint in the vertical axis of the implement support universal joint and the shaft extends horizontally adjacent the implement to indicate the tilt angle of the implement relative to the vehicle. The implement preferably includes a plurality of shaft support indicator means, such as brackets, which receive and slidably support the indicator shaft on the implement to indicate the relative movement of the shaft and the implement. In the preferred embodiment for indicating the tilt of a bulldozer blade, a plurality of brackets are mounted on the back of the blade which slidably receive and support the indicator shaft including an indicator bracket which telescopically receives the free end of the shaft providing an accurate visual indication of the relative tilt angle of the blade.

7 Claims, 3 Drawing Sheets

DOZER BLADE VISUAL TILT INDICATOR

FIELD OF THE INVENTION

This invention relates to a visual tilt indicator which is particularly, although not exclusively, suitable for indicating the tilt of a dozer blade which is supported on a tractive vehicle by a center universal joint.

BACKGROUND OF THE INVENTION

Reference is made to co-pending applications for United States patent, Ser. Nos. 083,533 and 083,595 filed Aug. 7, 1987 which disclose improvements in dozer blade mounting assemblies. The disclosed embodiments of the dozer blade mounting assemblies include a central ball joint which supports the lower center of the dozer blade on the C-frame for angling and tilting movement of the blade, and an upper universal connection which limits or prevents pitching of the upper portion of the blade rearwardly or forwardly. The support includes conventional angling cylinders interconnected between the dozer adjacent the longitudinal axis of the dozer and the sides of the blade and a tilt cylinder which extends generally horizontally and is connected to the dozer blade mounting assembly at one end and a side of the blade at the other end. Thus, the blade may be angled about a vertical axis of the ball joint by the angling cylinders and the blade may be tilted about a horizontal axis of the ball joint by the tilt cylinder.

Reference is also made to U.S. Pat. No. 4,201,268 assigned to the assignee of the present application which discloses the general arrangement of the dozer blade mounting assembly disclosed herein wherein the blade may be angled, tilted and pitched, and U.S. Pat. Nos. 3,645,340, 3,690,386, 3,705,631, 3,774,696 and 4,023,624 which disclose various blade mounting assemblies and controls for supporting a bulldozer blade and movement of the blade by hydraulic cylinders for various dozing applications. As will be understood, the tilt of a dozer blade about the longitudinal horizontal axis of the vehicle must be adjusted with relative accuracy in many dozing applications. Further, the dozing application may require repeated setting of the blade tilt angle to the same or different degrees of tilt. In such applications, it is often necessary for the operator to check the tilt angle, sometimes requiring the operator to go to the front of the blade to accurately determine the tilt angle of the blade. Further, where the blade mounting assembly permits angling, tilting and pitching, the tilt angle may change as the blade is pitched in some blade mounting arrangements. There is, therefore, a need for a simple inexpensive visual tilt indicator which may be observed from the operator's position or station and which provides an accurate indication of the tilt angle of the blade. Further, such a tilt indicator would be useful on other types of implements mounted on a vehicle.

SUMMARY OF THE INVENTION

The visual tilt indicator of this invention is particularly suitable for an implement, such as a dozer blade, pivotally mounted on a vehicle by a universal joint. The mounting assembly preferably includes an angle-tilt means, such as hydraulic cylinders, operably interconnected between the vehicle and the implement adapted to angle the implement relative to the vehicle about a generally vertical axis of the universal joint and tilt the implement relative to the vehicle about a generally horizontal axis of the universal joint. The visual tilt indicator includes an indicator shaft which is pivotally connected relative to the vehicle by a universal joint generally in the vertical axis of the universal joint supporting the implement. The shaft extends laterally from its universal connection and the implement includes a shaft support and indicator means which receives and slidably supports the indicator shaft on the implement indicating the relative movement of the indicator shaft and the implement. This relative movement between the indicator shaft and the implement is proportional to the tilt angle of the implement relative to the vehicle.

In the disclosed embodiment, the implement includes a plurality of spaced brackets having aligned openings mounted on the implement, preferably on the back of the implement for viewing from the operator's position, which slidably receive and support the indicator shaft. In the most preferred embodiment, the brackets include an indicator bracket adjacent the free end of the indicator shaft which telescopically receives the indicator shaft during tilting of the implement. The indicator bracket thus provides a clear and relatively precise visual indication of the tilt angle of the implement relative to the vehicle.

In the disclosed embodiment, the visual tilt indicator is specifically adapted to indicate the tilt angle of a dozer blade relative to the tractive vehicle. The lower midportion of the dozer blade is mounted on a frame member which extends across the forward end of the dozer by a ball joint and the frame includes a mast which extends upwardly adjacent the back of the blade connected to the blade by a universal connection spaced above the ball joint. The mounting arrangement further includes hydraulic angling and tilt cylinders connected to the mast and the back of the blade for angling and tilting the blade, as described. The tilt indicator shaft is pivotally connected to the upper universal connection of the blade to the mast by a universal joint and the indicator shaft extends generally horizontally across the back of the dozer blade. As described, a plurality of spaced brackets are attached to the back of the blade having horizontally aligned openings which receive and slidably support the indicator shaft to indicate the tilt angle of the blade.

The visual tilt indicator of this invention is therefore relatively inexpensive and simple in construction and provides a visual indication of the tilt angle of the blade from the operator's station. As the tilt angle is changed by operation of the angle-tilt means, the implement is moved relative to the indicator shaft through the openings in the brackets to indicate the tilt angle of the blade or implement relative to the vehicle. Other advantages and meritorious features of the present invention will be more fully understood from the following description of the preferred embodiments, the appended claims and the drawings, a brief description of which follows.

DESCRIPTION OF THE PREFERRED EMBODIMENT

Figure 1:
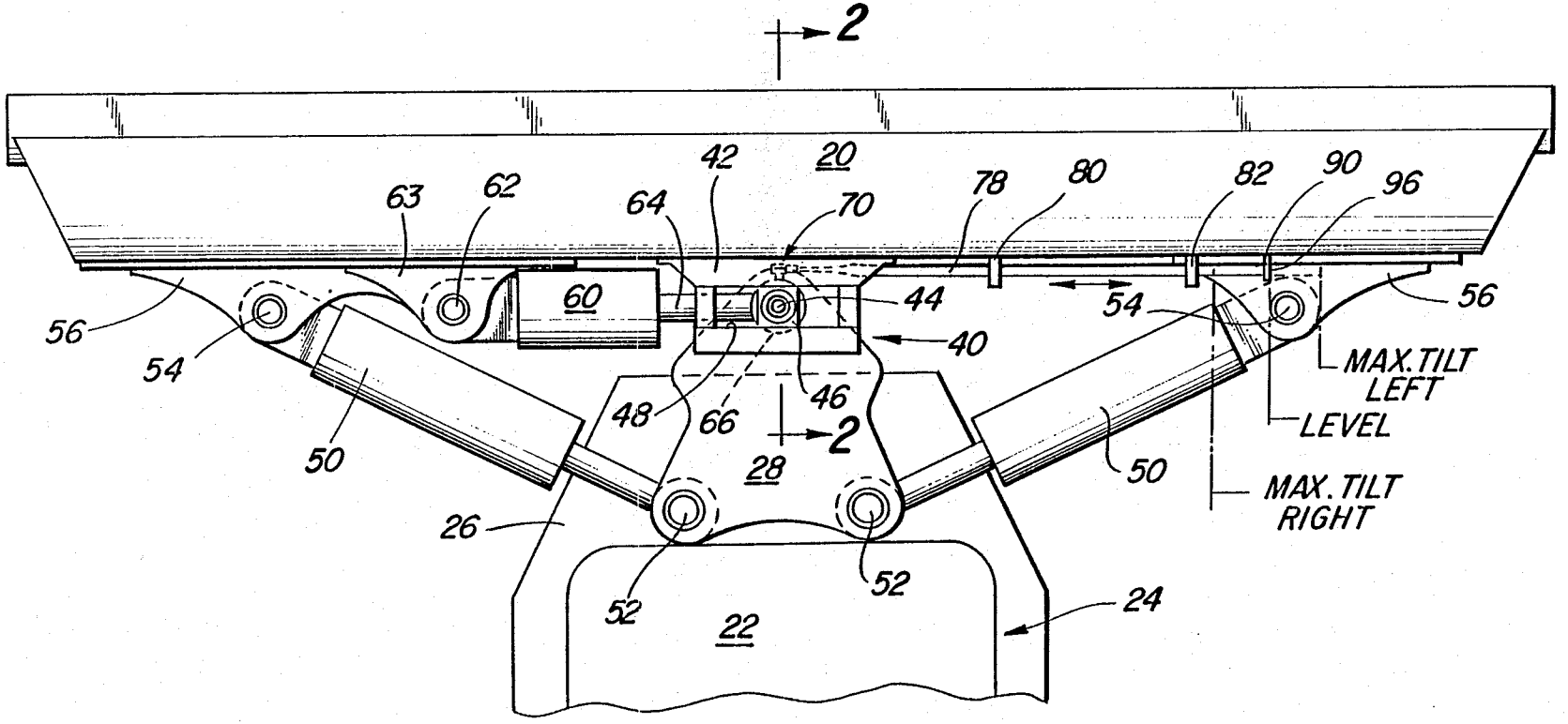
FIG. 1 is a partial top elevation of one embodiment of a dozer blade mounting assembly with an embodiment of the visual tilt indicator of this invention.
Figure 2:
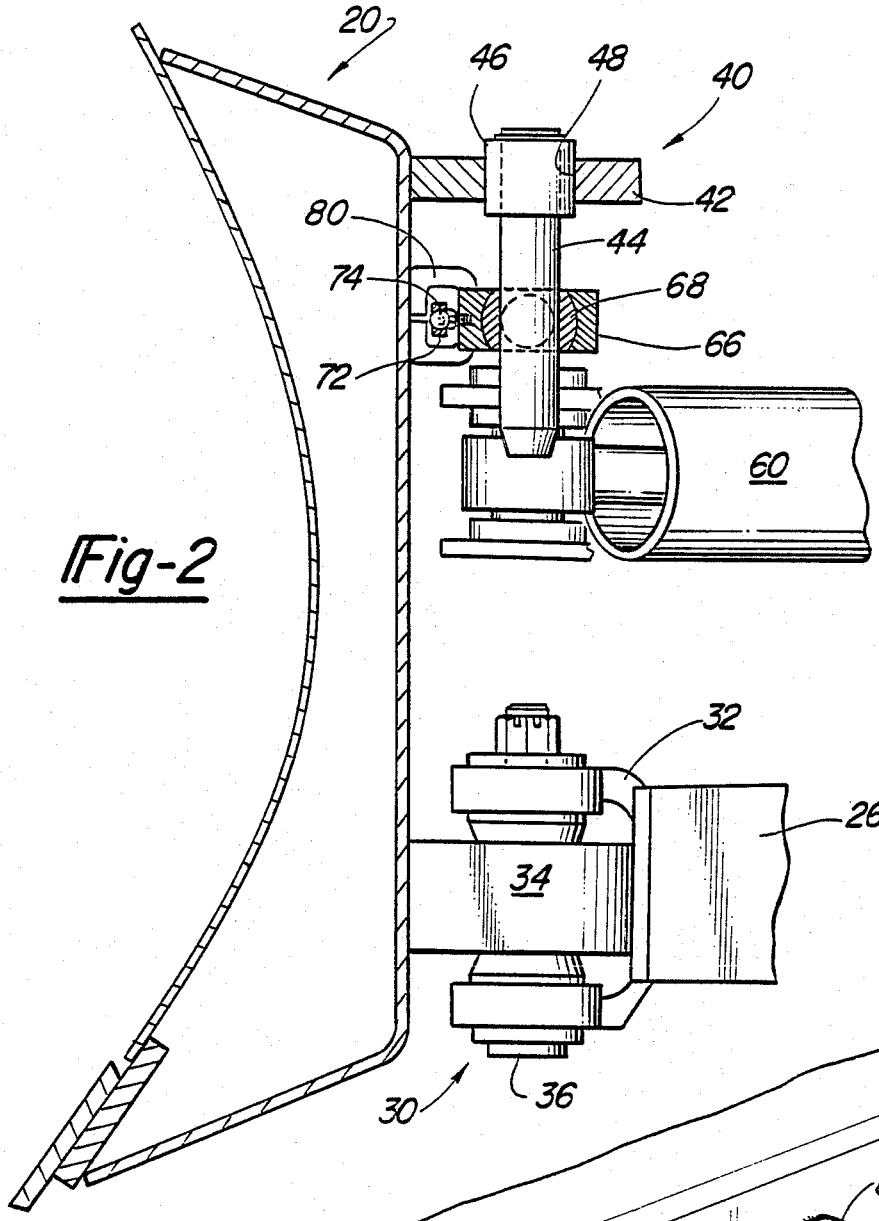
FIG. 2 is a partial side cross-sectional view of the embodiment shown in FIG. 1 in the direction of view arrows 2—2.

FIGS. 1 and 2 illustrate a mounting assembly for a dozer blade 20 as disclosed in above-referenced copending application Ser. No. 083,533 incorporated herein by reference. The bulldozer 22 includes a convention C-frame 24 having a cross member 26 extending across the forward end of the dozer 22. The C-frame 24 may be pivotally supported on the bulldozer adjacent the rearward end, not shown, and the C-frame may be supported at its forward end by lift cylinders, not shown. The disclosed embodiment of the dozer blade mounting assembly includes an upwardly extending mast assembly 28 as disclosed in above-referenced copending application. The lower midportion of the blade is supported by a conventional ball joint 30 as shown in FIG. 2, wherein a clevis 32 is welded or otherwise secured to the cross member 26 of the C-frame and a bracket 34 is welded or otherwise secured to the lower midportion of the back of the blade 20. A ball member (see FIGS. 4 and 5) is secured to the midportion of shaft 36 and the bracket 34 includes a ball socket (not shown) providing universal movement of the blade 20 on the ball joint 30. As disclosed more fully in our above referenced copending application, the ball joint is located in the longitudinal axis of the dozer 22 such that the blade 20 may be angled or tilted. As will be understood, a two dimensional universal joint may also be utilized where only two degrees of freedom are required.

The upper portion of the blade is supported by universal connection 40 which includes a bracket 42 welded or otherwise secured to the upper midportion of the blade spaced vertically above the ball joint 30 in the vertical axis of the ball joint. The universal connection 40 further includes a vertical shaft 44 which is fixed to the mast 28 and a guide block 46 rotatably mounted on shaft 44 which moves laterally in slot 48 of bracket 42. The guide block 46 is rotatably mounted on shaft 44 and therefore the universal connection 70 permits angling of the blade 20 about the vertical axis of shaft 44, which is coaxially aligned with the vertical axis of ball joint 30, and tilting of the blade about the horizontal axis of ball joint 30, wherein the guide block 46 slides in slot 48 of bracket 42.

The disclosed embodiment of the blade mounting assembly further includes a pair of angling cylinders 50 which are connected at their rod ends by pivot pins 52 to mast assembly 28 adjacent the longitudinal axis of dozer 22 and the head ends of the angling cylinders 50 are connected by pivot pins 54 to brackets 56 welded or otherwise secured to the back of blade 20. The disclosed embodiment of the blade mounting assembly further includes a tilt cylinder 60 having a head end which is pivotally attached by pivot pin 62 to bracket 63, which is welded or otherwise secured to the back of the blade. The tilt cylinder rod 64 includes a rod eye 66 which is universally connected to vertical shaft 44 as best shown in FIG. 2. The rod eye 66 includes a ball member 68 which is connected to shaft 44 permitting universal movement.

The operation of the dozer blade mounting assembly shown in FIGS. 1 and 2 is therefore briefly as follows: The blade 20 may be angled about the vertical axes of ball joint 30 and shaft 44 by extending one angle cylinder 50 and retracting the other. The blade may be tilted by extending or retracting tilt cylinder 60. As will be understood, the angling and tilt cylinders, 50 and 60 respectively, are hydraulic piston-cylinders having conventional hydraulic controls as disclosed in our above-referenced copending application. The blade cannot be pitched because the upper universal joint 40 will not permit movement of the upper portion of the blade forwardly or rearwardly. As disclosed more fully hereinbelow, however, the visual tilt indicator of this invention may be used with blade mounting assemblies which permit pitching of the blade.

Figure 3:
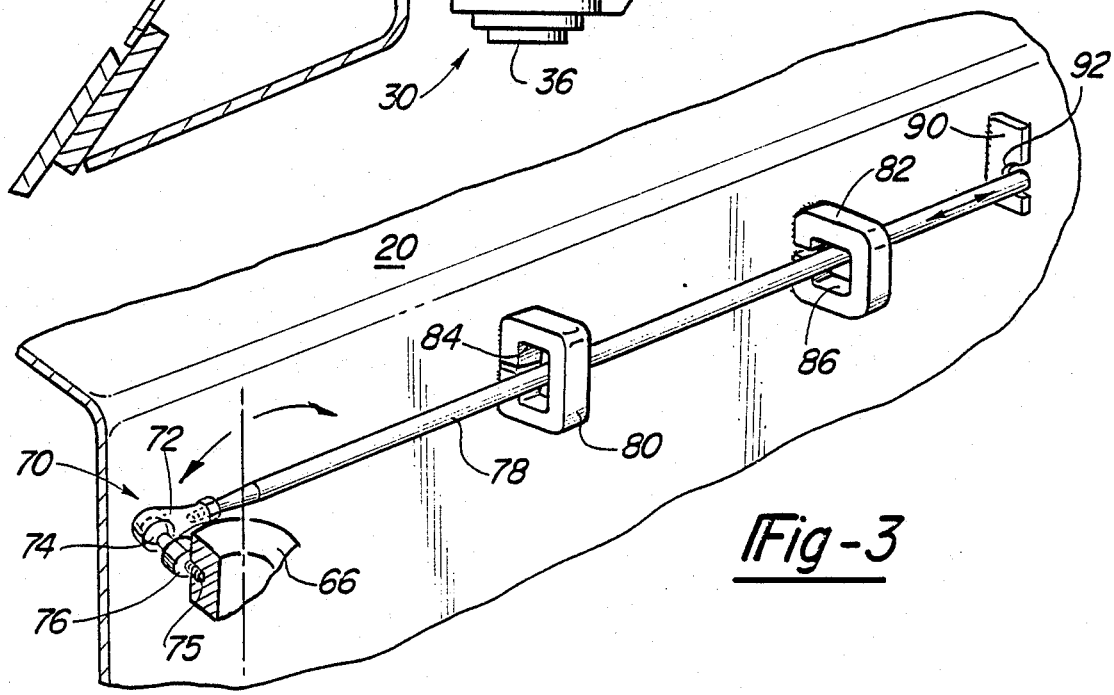
FIG. 3 is a partial side elevation, partially cross-sectioned view of the visual tilt indicator shown in FIGS. 1 and 2.

The disclosed embodiment of the dozer blade tilt indicator includes a shaft 78 which is operably connected by a universal joint 70 to the dozer and the blade 20 moves relative to the shaft 78 during tilting of the blade. As best shown in FIG. 3, the disclosed embodiment of the universal joint 70 includes a socket member 72, which is threaded or otherwise attached to shaft 78, a ball member 74 having an integral shaft 75 which is threaded or otherwise attached to rod eye 66 of the tilt cylinder 50 and the shaft 75 is secured by a lock nut 76. As will be understood from the following description, the shaft 78 serves as a pointer to visually indicate the tilt angle of the blade 20. In the disclosed embodiment, the shaft or pointer 78 extends laterally from universal connection 70, preferably generally horizontally, as shown in FIG. 3. The pointer shaft 78 is supported on the back of the blade by guide blocks or brackets 80, 82 having aligned openings 84, 86 which receive and slidably support pointer shaft 78. In the most preferred embodiment, an indicator bracket 90 having an opening 92 telescopically receives the free end 96 of the pointer shaft 78 during tilting of the blade. As shown, the guide blocks 80 and 82 and indicator bracket 90 include successively smaller openings, 84, 86 and 92, respectively, to accommodate and control relative movement of the shaft 78.

Figure 4:
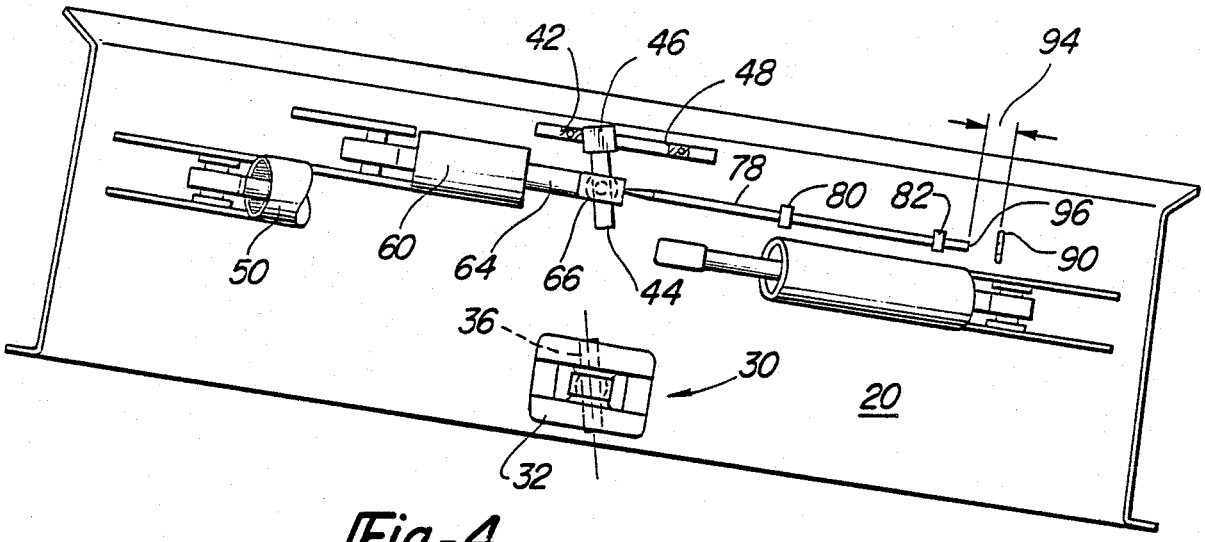
FIGS. 4 and 5 are partial cross-sectioned rear views of the dozer blade mounting assembly and visual tilt indicator shown in FIGS. 1 to 4 illustrating the operation of the visual tilt indicator of this invention.
Figure 5:
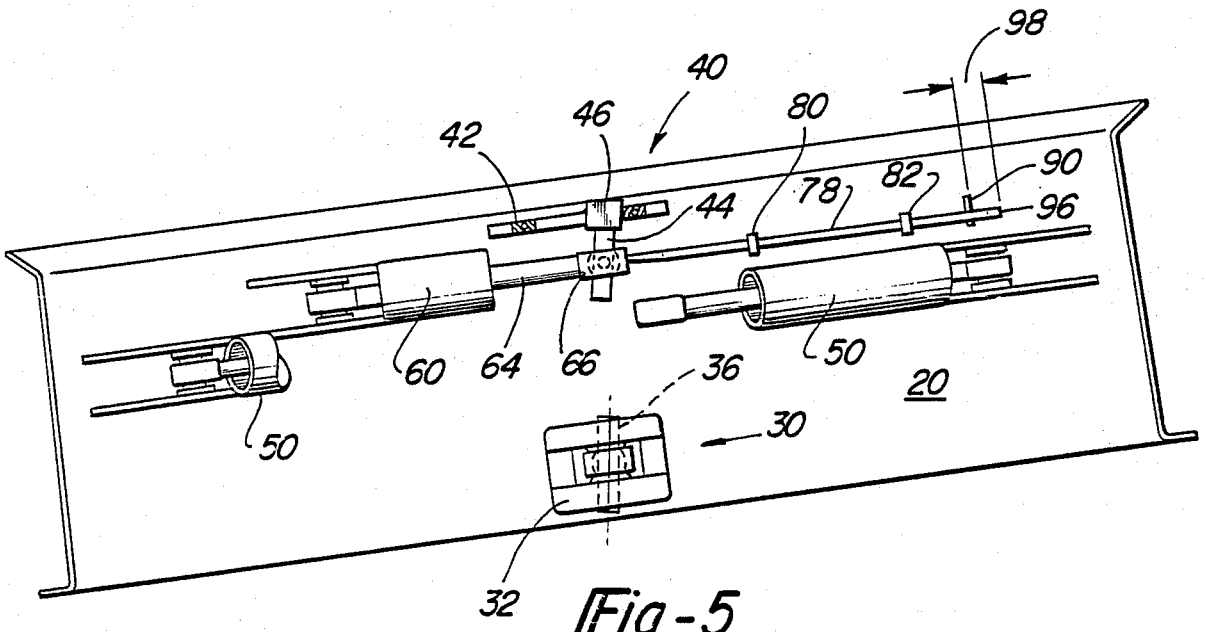

FIGS. 4 and 5 best illustrate the operation of the disclosed embodiment of the tilt indicator as the blade 20 is tilted by tilt cylinder 60. The pointer shaft 78 being attached to vertical pivot shaft 44 of the upper universal connection 40 is operably connected to the dozer and does not move as the blade 20 is tilted to the right as shown in FIG. 4 or to the left as shown in FIG. 5. When the blade is tilted to the right, as shown in FIG. 4, the end indicator bracket 90 moves further from the horizontal pivot axis of the center ball joint 30 creating a gap 94 between the free end 96 of pointer shaft 78 and indicator bracket 90. Thus, it may be said that the pointer shaft 78 moves relative to the blade 20 to the left in FIG. 4 when the blade is angled to the right. When the blade is angled to the left, as shown in FIG. 5, the end bracket 90 moves closer to the horizontal axis of ball joint 30 and the free end 96 of pointer shaft 78 is telescopically received through the opening (92 in FIG. 3) in the indicator bracket 90 a similar distance 98. The distances 94 and 98 are equal because the tilt angle is limited by guide block 46 in slot 48 of the upper universal connection 40 as shown in FIGS. 1 and 2. In the disclosed embodiment when the blade is level, as shown in FIG. 1, the free end 96 of pointer shaft 78 is located within indicator bracket 90. As will be understood, the dozer operator can see the location of the free end 96 of pointer shaft 78 at a glance from the operator's station on the dozer and the level position of the blade may be very accurately determined, permitting the operator to make very accurate, level dozer cuts with the blade. Further, the operator can also see the degree of tilt of the blade by visually checking the free end 96 of the pointer shaft 78 relative to the indicator bracket 90. the free end 96 of the shaft and the indicator bracket 90 may be painted contrasting bright colors to further enhance visual inspection of the degree of tilt of the blade 20. Thus, the dozer tilt indicator of this invention provides a simple, relatively inexpensive means of visually determining the degree of tilt of the blade 20 from the operator's station of the dozer.

As will be understood, various modifications may be made to the visual tilt indicator of this invention within the purview of the following claims. The dozer blade mounting assembly disclosed herein is exemplary only of one suitable environment for the tilt indicator of this invention. For example, the tilt indicator may be used in an angle, tilt and pitch blade mounting assembly provided the indicator shaft is fixed relative to the tilt axis or operatively fixed to the dozer or blade mounting frame. That is, the indicator shaft may be pivotally connected to the vehicle or an element fixed on the vehicle such that the blade moves relative to the pointer shaft. In the disclosed embodiment of the blade mounting assembly, the pointer shaft could be pivotally mounted on the vertical pivot pin 44 of the upper universal connection 40. Alternatively, the tilt indicator of this invention may be used to visually indicate the tilt of other implements, particularly agricultural and construction implements which are attached to a prime mover or tractive vehicle.

We claim:

1. A visual tilt indicator for an implement mounted on a vehicle, said implement pivotally mounted on said vehicle by an implement universal joint, angle-tilt means operably interconnected between said vehicle and said implement adapted to angle said implement relative to said vehicle about a generally vertical axis of said implement universal joint and tilt said implement relative to said vehicle about a generally horizontal axis of said implement universal joint, said visual indicator comprising an indicator shaft operatively connected to said vehicle by an indicator universal joint generally in said implement universal joint vertical axis, said indicator universal joint allowing said indicator shaft to rotate relative to said vehicle about a vertical axis and about a horizontal axis, said indicator shaft extending laterally from said indicator universal joint and said implement having shaft support indicator means receiving and slidably supporting said indicator shaft on said implement indicating the relative movement of said indicator shaft and said implement, said relative movement indicating visually the tilt of said implement relative to said vehicle for adjustment by said angle-tilt means.

2. The visual tilt indicator defined in claim 1, characterized in that said shaft support indicator means comprising a plurality of spaced brackets mounted on said implement having aligned openings receiving and slidably supporting said indicator shaft.

3. The visual tilt indicator defined in claim 1, characterized in that said implement is further supported on said vehicle by a second implement joint spaced vertically above said implement universal joint in said vertical axis and said indicator shaft is operably connected to said second implement universal joint by said indicator universal joint.

4. A visual tilt indicator for a dozer blade mounted on a tractive vehicle, a blade support frame at the forward end of said vehicle mounted on said vehicle, a lower midportion of said blade mounted on said blade support frame by a blade universal joint generally in a longitudinal axis of said tractive vehicle, a mast assembly connected to said frame extending upwardly from said frame adjacent said blade midportion, universal connection means interconnecting said mast and an upper midportion of said blade spaced above said blade universal joint, hydraulic angle-tilt means interconnected between said mast and said blade adapted to angle said blade relative to said vehicle about a generally vertical axis of said blade universal joint and tilt said blade relative to said vehicle about a generally horizontal axis of said blade universal joint, said visual tilt indicator comprising an indicator shaft operatively connected to said mast by an indicator universal joint, said indicator universal joint allowing said indicator shaft to rotate relative to said vehicle about a vertical axis and about a horizontal axis, said indicator shaft extending generally horizontally from said indicator universal joint, and said blade having shaft support indicator means receiving and slidably supporting said indicator shaft on a back surface of said blade and indicating the relative movement of said indicator shaft and said blade, said shaft support indicator means including a bracket, the bracket being positioned such that an axial end of said shaft is aligned within said bracket when the blade is untilted and wherein said shaft axial end moves out of said bracket or extends through said bracket in response to a tilt of said blade, the movement of said shaft indicting visually the tilt angle of said blade relative to said vertical axis of said blade universal joint for adjustment of said tilt angle by said hydraulic angle-tilt means.

5. The visual indicator defined in claim 4, characterized in that said universal connection means includes a vertical shaft pivotally supporting an upper portion of said blade for angling and tilting movement of said blade and said blade indicator shaft operably connected to said vertical shaft by said indicator universal joint.

6. The visual tilt indicator defined in claim 5, characterized in that said angle-tilt means includes a generally horizontally extending hydraulic tilt cylinder connected to said vertical shaft by a universal connection and to said blade to tilt said blade about said horizontal axis of said blade universal joint and said shaft connected to said tilt cylinder universal connection by said indicator universal joint.

7. The visual tilt indicator defined in claim 4, characterized in that said shaft support indicator means comprises a plurality of spaced brackets mounted on said back surface of said blade having aligned openings receiving and slidably supporting said indicator shaft including an indicator bracket adjacent a free end of said indicator shaft which telescopically receives said indicator shaft free end to indicate the relative position of said indicator shaft and said indicator bracket thereby visually indicating the tilt angle of said blade.

* * * * *